US009395076B2

(12) United States Patent
Wang et al.

(10) Patent No.: US 9,395,076 B2
(45) Date of Patent: Jul. 19, 2016

(54) REMOTE CONTROL AND INFLATABLE PRODUCT USING THE SAME

(71) Applicant: Team Worldwide Corporation, Taipei (TW)

(72) Inventors: Cheng-Chung Wang, Taipei (TW); Chien-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 82 days.

(21) Appl. No.: 14/201,397

(22) Filed: Mar. 7, 2014

(65) Prior Publication Data

US 2014/0268645 A1 Sep. 18, 2014

(30) Foreign Application Priority Data

Mar. 13, 2013 (CN) ..... 2013 2 0114681 U

(51) Int. Cl.

| | |
|---|---|
| ***F21V 33/00*** | (2006.01) |
| ***A47C 27/08*** | (2006.01) |
| ***A47C 31/00*** | (2006.01) |
| ***A63H 30/00*** | (2006.01) |
| *A61G 7/057* | (2006.01) |

(52) U.S. Cl.

CPC ..... *F21V 33/0004* (2013.01); *A47C 27/081* (2013.01); *A47C 31/008* (2013.01); *A63H 30/00* (2013.01); *A61G 7/05769* (2013.01); *A61G 2203/12* (2013.01); *Y10T 137/3584* (2015.04)

(58) Field of Classification Search

CPC ... F21V 33/0004; F21V 14/02; F21V 14/025; F21V 19/02; F21V 21/14; F21V 21/145; F21V 21/30; A63H 30/00; Y10T 137/3584; A61G 7/05769; A61G 2203/12; A47C 27/081; A47C 31/008

See application file for complete search history.

(56) References Cited

U.S. PATENT DOCUMENTS

| | | | | |
|---|---|---|---|---|
| 5,325,551 | A * | 7/1994 | Tappel | A47C 27/082 5/709 |
| 5,542,136 | A * | 8/1996 | Tappel | A61G 7/05776 5/658 |
| 6,483,264 | B1 * | 11/2002 | Shafer | A47C 27/082 318/16 |
| 2007/0227594 | A1 * | 10/2007 | Chaffee | A47C 27/082 137/224 |

* cited by examiner

*Primary Examiner* — Bao Q Truong

(57) ABSTRACT

A remote control for an inflatable product includes a top cover, a bottom cover correspondingly fitted to the top cover, an air pump switch mounted on the top cover to control on/off of the air pump and a lighting module.

19 Claims, 8 Drawing Sheets

REMOTE CONTROL AND INFLATABLE PRODUCT USING THE SAME

CROSS-REFERENCE TO RELATED APPLICATIONS

The present application claims priority to and the benefit of Chinese Patent Application No. CN201320114681.5, filed on Mar. 13, 2013. The entire content of which is incorporated herein by reference.

BACKGROUND

1. Field of the Invention

The present invention generally relates to a remote control having a lighting module, and more particularly, to an inflatable product using the same.

2. Description of the Related Art

With regard to inflatable product such as inflatable bed, inflatable desk, inflatable boat, inflatable toys . . . etc. is quite popular and very much appreciated by the general public for its light weight, affordability, and comfort. As these types of products can be used in different occasions, people often use the inflatable products in daily lives and/or travelling.

While using the inflatable products, an air pump either embedded inside the inflatable product or securely attached to a side of the inflatable product is an essential device to inflate the inflatable product. However, the air pump seems to have only one purpose and one purpose only. When night falls, and the user wants to read, the user has to turn on the light, which will adversely affect others. Also, even the user is trying to turn on the light in a dark night, the user needs to feel the way to reach the switch, which is quite inconvenient.

SUMMARY OF THE INVENTION

The embodiments of the present invention provide an improved remote control for an inflatable object and the inflatable object using the remote control. The remote control is equipped with lighting and control mechanism to facilitate the use of the novel remote control.

In order to accomplish the above mentioned objective, it is one objective of the preferred embodiment of the present invention to provide a remote control having a top cover, a bottom cover correspondingly fitted to the top cover, an air pump switch mounted on the top cover to control on/off of the air pump and a lighting module.

Another objective of the preferred embodiment of the present invention is that the lighting module is composed of a light bulb device whose brightness is controlled by a light switch.

Still another objective of the preferred embodiment of the present invention is that the on/off of the light bulb is controlled by a light switch.

Still another objective of the preferred embodiment of the present invention is that a linkage is provided to control lighting direction of the lighting module.

Still another objective of the preferred embodiment of the present invention is that the linkage is extendable along a length of the linkage inside a room defined between the top cover and the bottom cover.

Still another objective of the preferred embodiment of the present invention is that the linkage is provided with a stop to limit the extension of the linkage.

Still another objective of the preferred embodiment of the present invention is that the lighting module is composed of a light seat, a light bulb fixed on the light seat and a light switch to control the on/off of the light bulb.

Another objective of the present invention is that there is at least one light bulb.

Another objective of the present invention is that the light bulb may be a LED, a white light bulb or a phosphorous light bulb.

Still another objective of the preferred embodiment of the present invention is that the air pump switch is connected to the air pump via an electrical wire.

Still another objective of the preferred embodiment of the present invention is that the air pump switch is connected to the air pump via infrared.

Still another objective of the preferred embodiment of the present invention is that the bottom cover of the remote control is provided with a hook to facilitate storage of the remote control.

Still another objective of the preferred embodiment of the present invention is to provide an inflatable product having an inflatable body, an air pump, a remote control controlling inflation of the inflatable body and a receptacle device for storage of the remote control.

Still another objective of the preferred embodiment of the present invention is that the receptacle device is composed of a hook and a hook seat.

Still another objective of the preferred embodiment of the present invention is that the inflatable product is an inflatable bed, an inflatable sofa, an inflatable cushion or an inflatable chair.

BRIEF DESCRIPTIONS OF THE DRAWINGS

The embodiments of the invention are illustrated by way of examples, and in anyway the examples so provided shall not be interpreted as limiting the scope of the present invention. The examples are illustrated by way of the accompanying drawings.

DESCRIPTION OF SOME EMBODIMENTS

Figure 1:
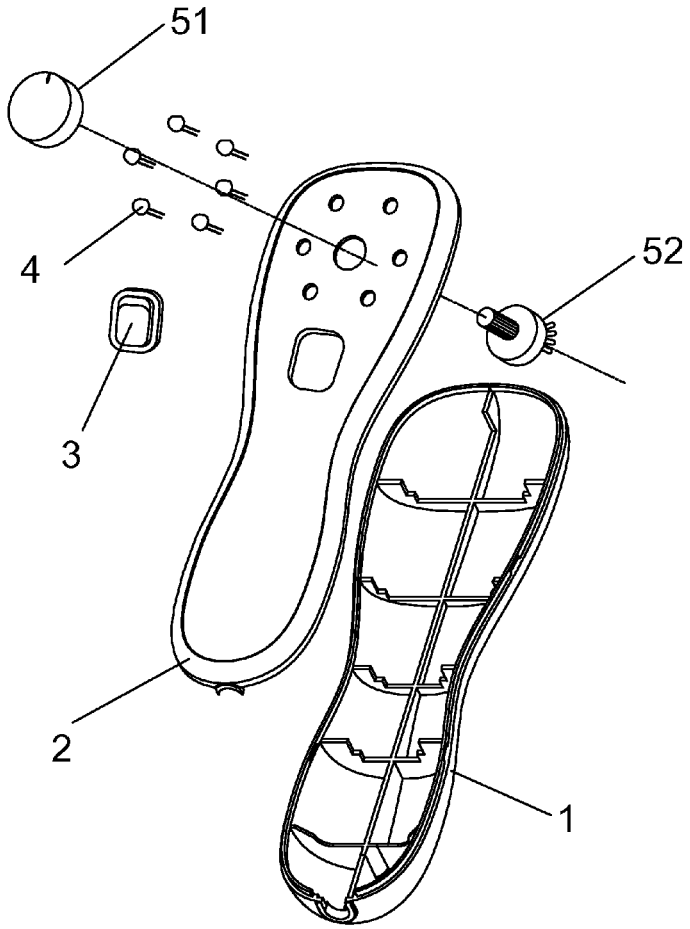
FIG. 1 is an exploded perspective view of the first example.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Numerical quantities given herein are approximately estimated, meaning that the term "around", "about" or "approximately" can be inferred if not expressly stated.

As used herein, the term "plurality" means a number greater than one.

Examples of a remote control of a first embodiment and constructed in accordance with the present invention are shown in the following drawings.

Figure 2:
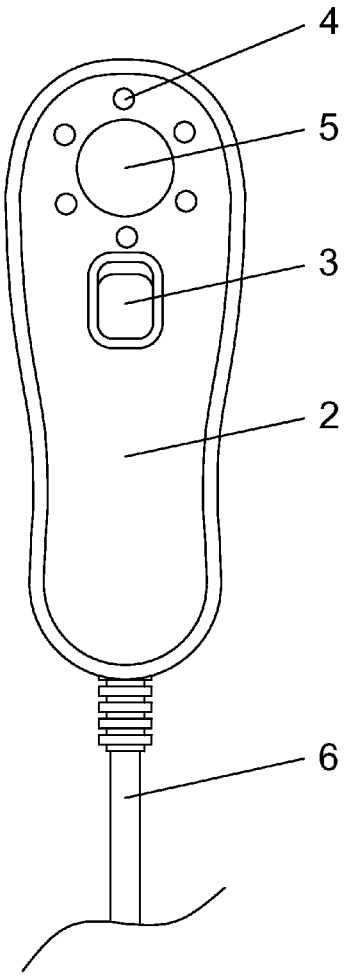
FIG. 2 is a top side plan view of the remote control of the preferred embodiment of the first example.

With reference to FIGS. 1 and 2, the remote control is composed of a top cover 2, a bottom cover 1 and an air pump switch 3 mounted on a face of the top cover 2. Also, a lighting module is provided on the remote control.

The light module includes at least one light bulb device 4 mounted on the top cover 2 and a light switch 5 controlling on/off as well as the brightness of the at least one light bulb device 4. The light bulb device 4 includes at least one light bulb evenly distributed on the top cover 2 and the at least one light bulb maybe a white light bulb, an LED light bulb or a phosphorous light bulb.

The light switch 5 is a mechanical switch which could be a rotary switch; a toggle switch or a push button. In this preferred embodiment, the light switch 5 includes a cover 51 and a button 52. Rotating the cover 51 drives the button 52 to initiate on/off of the light bulb device 4.

The remote control for an air pump is connected to the air pump via an electrical wire 6.

The bottom cover 1 is provided with a hook 10 or a hook seat 15. In this preferred embodiment, there is a hook mounted on a side of the bottom cover 1 to allow the remote control of the preferred embodiment of the present invention to be placed in a predetermined position on the inflatable product.

Example 2

Figure 3:
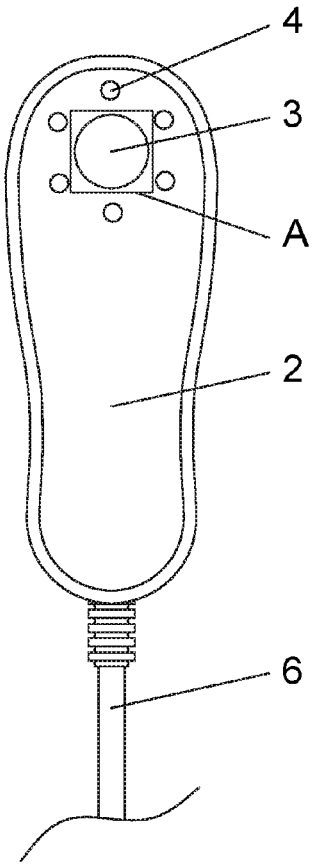
FIG. 3 is a top side plan view of the remote control of the preferred embodiment of the second example.
Figure 4:
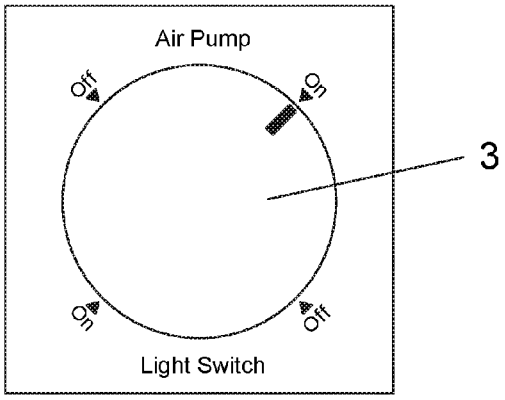
FIG. 4 is an enlarged top side plan view of the area marked A in FIG. 3.

With reference to FIGS. 3 and 4, a remote control for an air pump includes a top cover 2, a bottom cover 1 correspondingly fitted to the top cover 2 and an air pump switch 3 provided on a face of the top cover 2. Further, a lighting module is provided to the remote control. The lighting module includes a light bulb device 4 mounted on a front side face of the top cover 2 and whose brightness and on/off is controlled by the air pump switch 3. The light bulb device 4 maybe composed of one light bulb or more than one. In this preferred embodiment, there are six light bulbs evenly distributed on the top cover 2 and the light bulb could be a LED light bulb, a white light bulb or a phosphorous light bulb. As shown in FIG. 4, the air pump switch 3 is a rotary switch with four different settings to respectively control on/off of the air pump and on/off of the light bulb as well as the brightness of the light bulb. The remote control is connected to the air pump via an electrical wire 6, infrared or RF (radio frequency). The bottom cover 1 is provided with a hook 10 or a hook seat 15. In this preferred embodiment, there is a hook mounted on a side of the bottom cover 1 to allow the remote control of the preferred embodiment of the present invention to be placed in a predetermined position on the inflatable product.

Example 3

Figure 5:
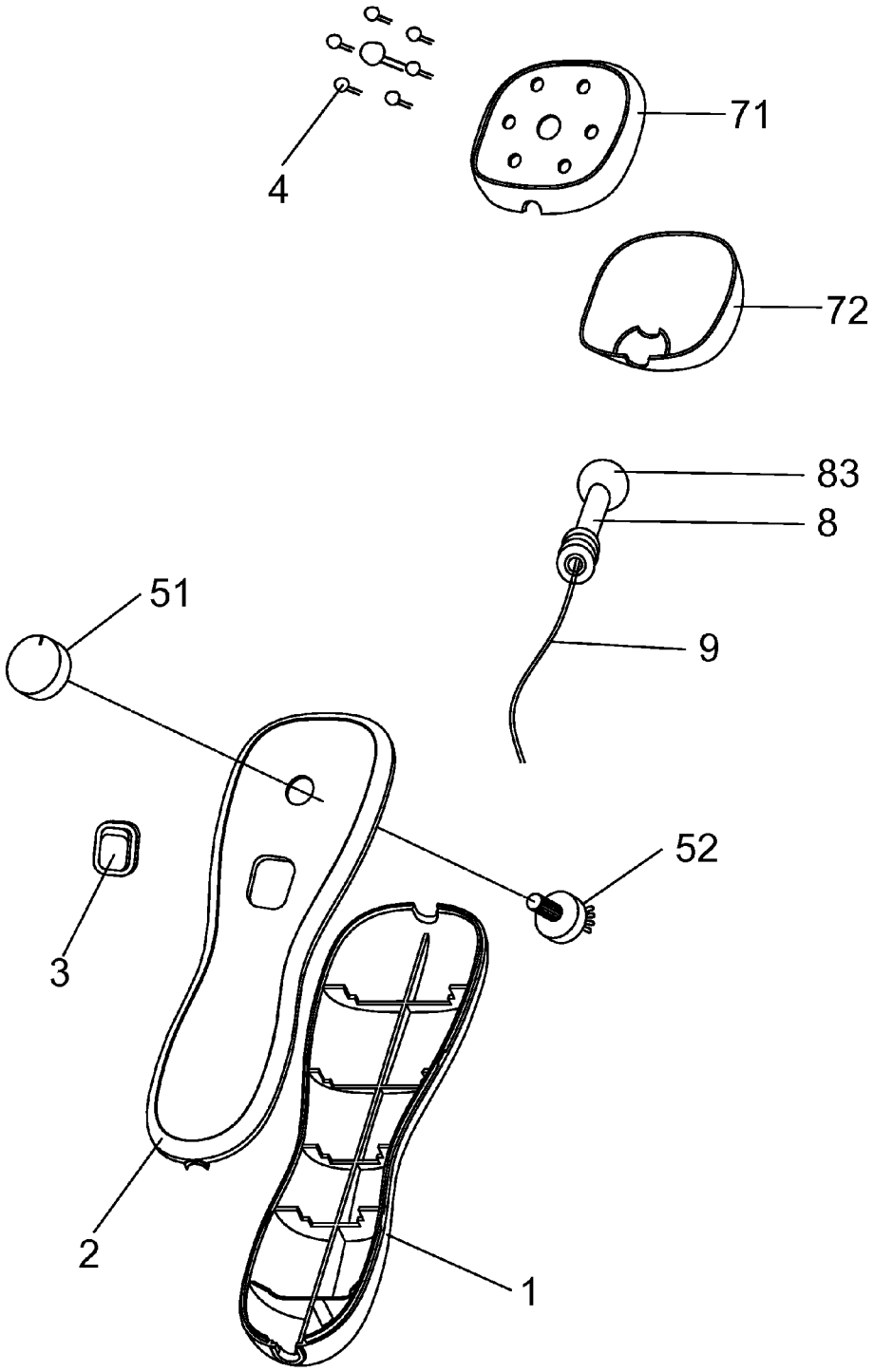
FIG. 5 is an exploded perspective view of the third preferred embodiment of the present invention.
Figure 6:
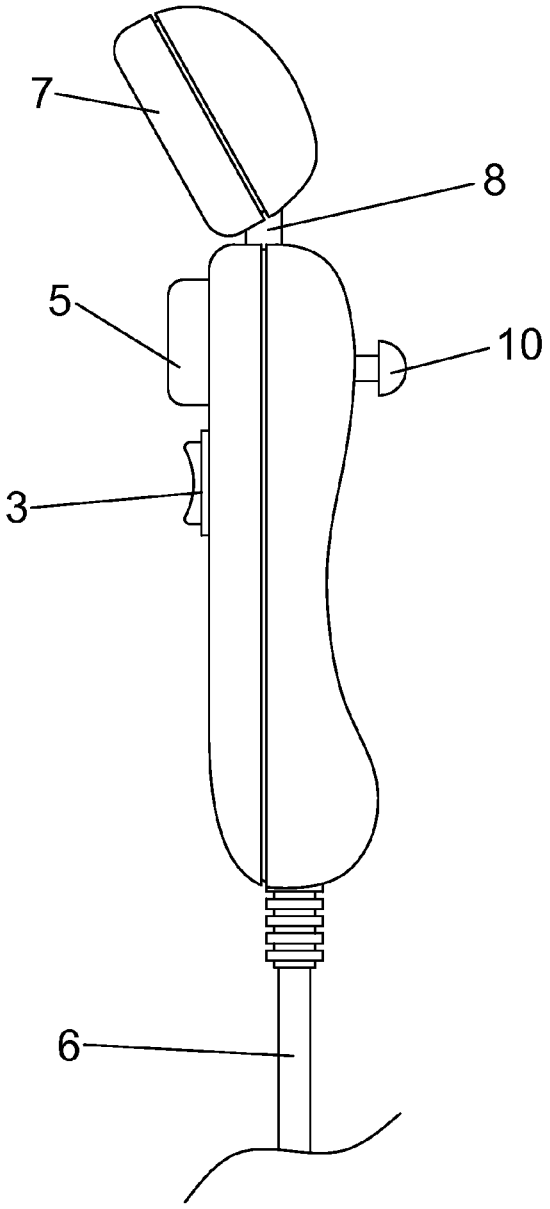
FIG. 6 is a right side plan view of the third preferred embodiment of the present invention.
Figure 7:
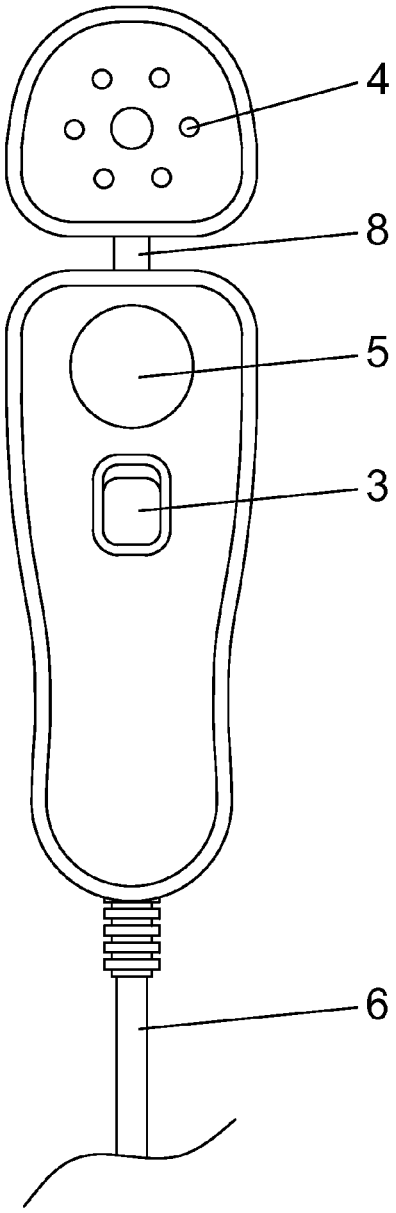
FIG. 7 is a front side plan view of the third preferred embodiment of the present invention.

With reference to FIGS. 5, 6 and 7, a remote control for an air pump includes a top cover 2, a bottom cover 1 correspondingly fitted to the top cover 2 and an air pump switch 3 provided on a face of the top cover 2. Further, a lighting module is provided to the remote control. The lighting module includes a light seat 7 connected to the top cover 2 and the bottom cover 1 via a linkage 8, a light bulb device 4 mounted on the light seat 7. The top cover 2 is provided with a light switch 5 controlling on/off as well as brightness of the light bulb device 4. The linkage 8 is a hollow structure to receive therein a light bulb wire 9 for providing electricity to the light bulb device 4. The linkage 8 has a head 83 securely formed on a distal end thereof, yet rotatably received in a concave (not numbered) defined in the light seat 7 such that the light seat 7 is rotatable relative to the linkage 8. The remote control is connected to the air pump via an electrical wire 6, infrared or RF (radio frequency). The bottom cover 1 is provided with a hook 10 or a hook seat 15. In this preferred embodiment, there is a hook mounted on a side of the bottom cover 1 to allow the remote control of the preferred embodiment of the present invention to be placed in a predetermined position on the inflatable product for storage.

Example 4

Figure 8:
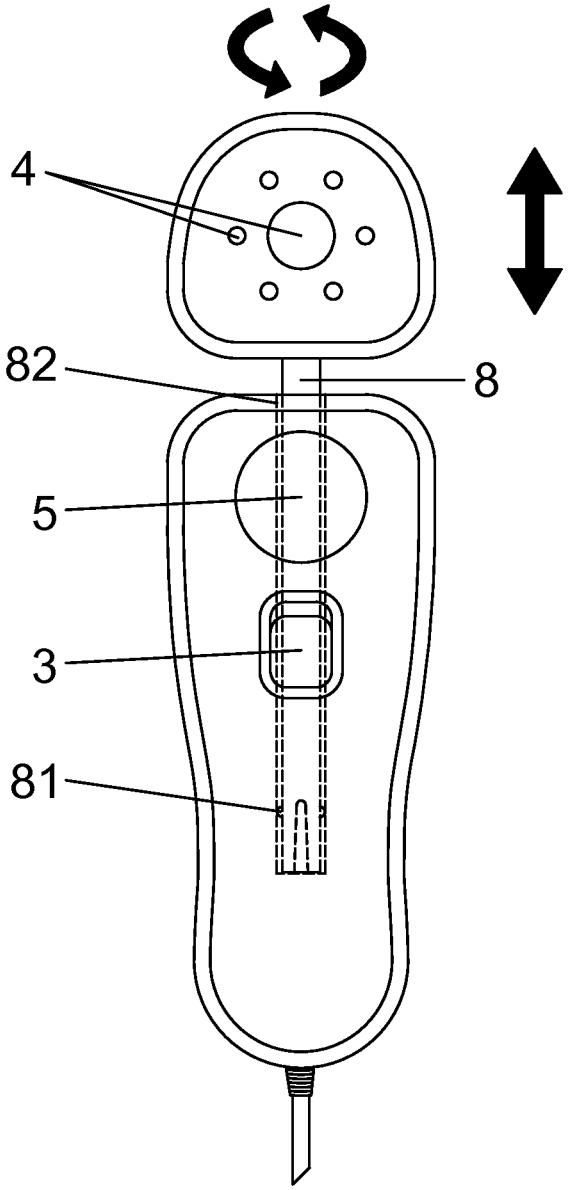
FIG. 8 is a front side plan view of the fourth preferred embodiment of the present invention.
Figure 9:
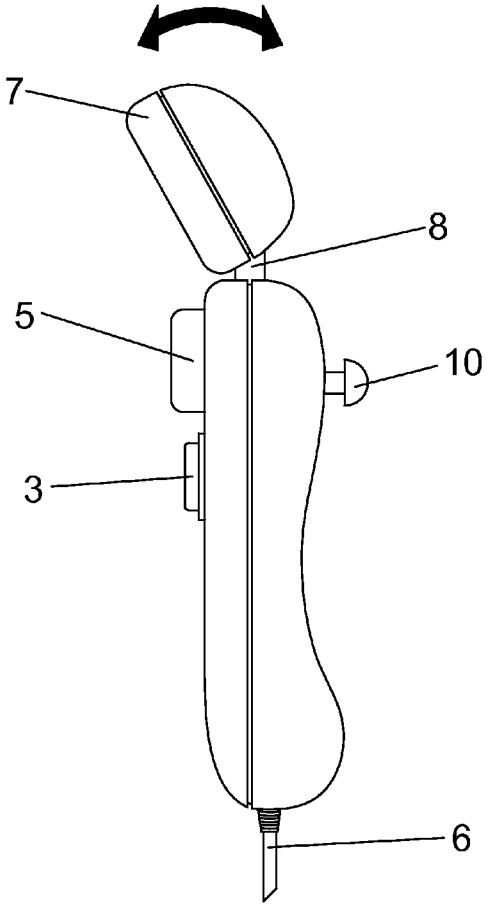
FIG. 9 is a right side plan view showing the application of the fourth preferred embodiment of the present invention.
Figure 10:
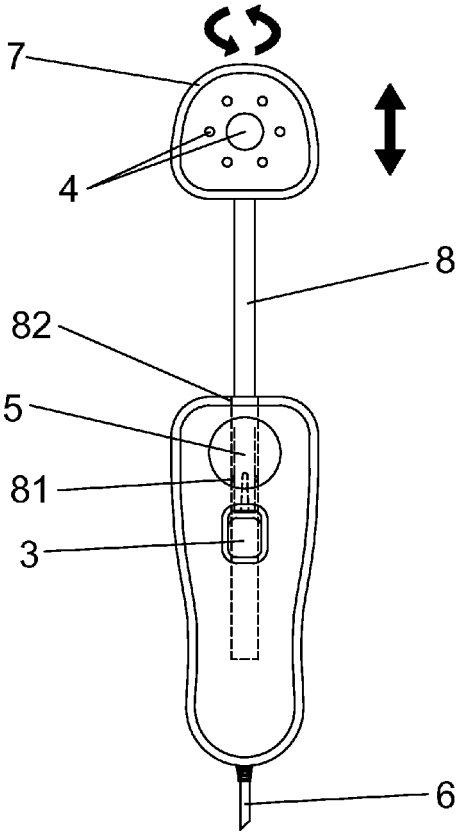
FIG. 10 is still a front side plan view showing another application of the fourth preferred embodiment of the present invention.

With reference to FIGS. 8, 9 and 10, in this embodiment, the difference when compared with example 3 is that the linkage 8 is extendable in a space defined between the top cover 2 and the bottom cover 1. In order to position the linkage 8 after extension or extraction, the linkage 8 is provided with a boss 81 and a position track 82 for positioning the linkage 8. With this structure, not only rotational/pivotal movement of the light seat 7 relative to the linkage 8 is possible, the light seat 7 can also be extendable to adjust angle and increase the reach of the light device 4. This assembly is simple in design yet comes in handy when in use.

Example 5

Figure 11:
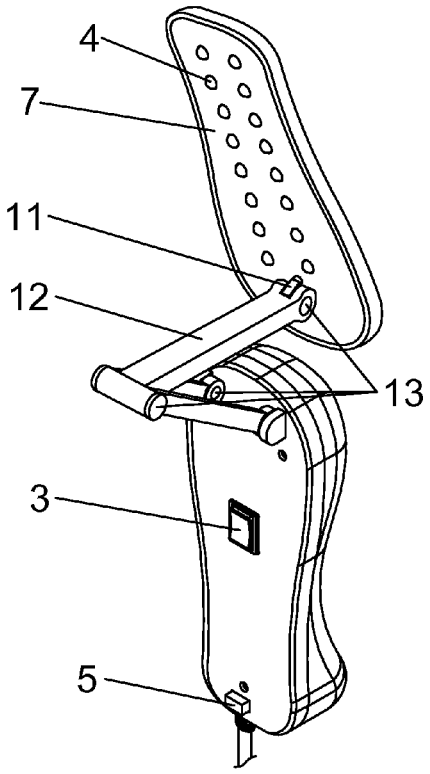
FIG. 11 is a perspective view showing the fifth preferred embodiment of the present invention.

With reference to FIG. 11, a remote control for an air pump includes a top cover 2, a bottom cover 1 correspondingly fitted to the top cover 2 and an air pump switch 3 provided on a face of the top cover 2. Further, a lighting module is provided to the remote control. The lighting module includes a light seat 7, a light bulb device 4 securely mounted on a side of the light seat 7. The light seat 7 is connected to the top cover 2 and the bottom cover 1 via a foldable arm 12 whose one distal end is securely connected to the top cover 2 or the bottom cover 1 via an axle 13 and the other distal end is pivotally connected to a side face of the light seat 7 via an universal joint 11.

The light module includes at least one light bulb device 4 mounted on the light seat 7 and a light switch 5 controlling on/off as well as the brightness of the at least one light bulb device 4. The light bulb device 4 includes at least one light bulb evenly distributed on the light seat 7 and the least one light bulb maybe a white light bulb, an LED light bulb or a phosphorous light bulb.

The remote control for an air pump is connected to the air pump via an electrical wire 6.

The bottom cover 1 is provided with a hook 10 or a hook seat 15. In this preferred embodiment, there is a hook mounted on a side of the bottom cover 1 to allow the remote control of the preferred embodiment of the present invention to be placed in a predetermined position on the inflatable product.

When not in use, the light seat 7 can be folded to save space and when in use, the light seat 7 can be extended via the foldable arm 12 to adjust angle of the light seat and satisfy the needs. With the provision of the foldable arm 12, the angle adjustment of the light seat can be easily achieved.

Example 6

Figure 12:
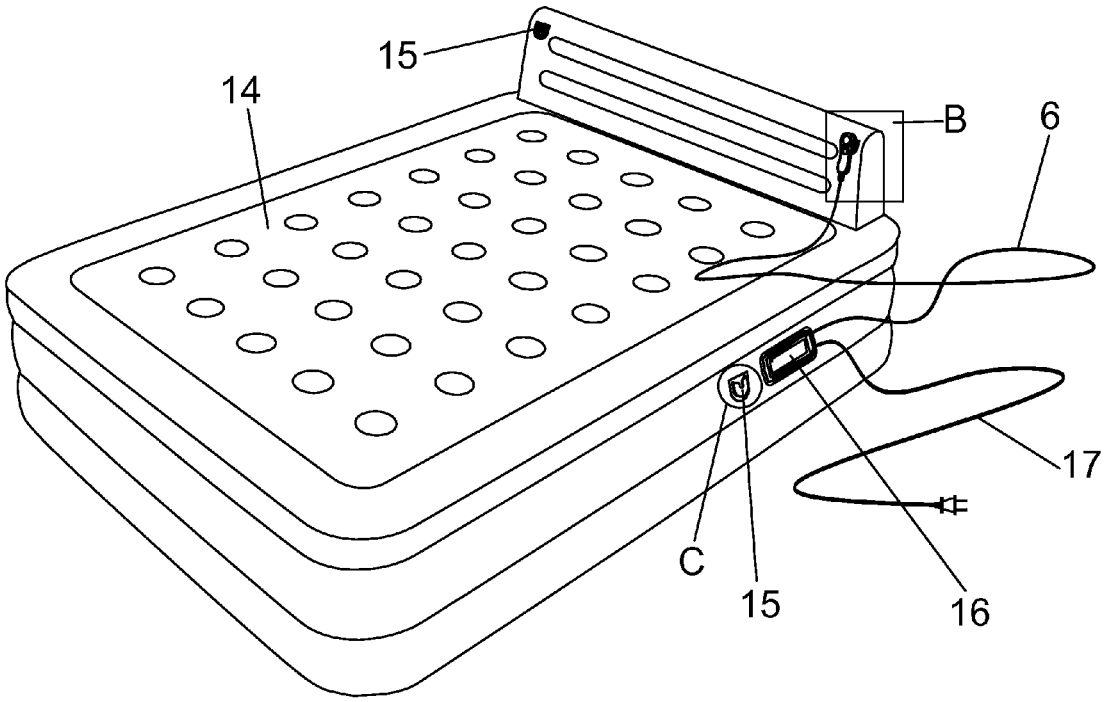
FIG. 12 is a perspective view showing the sixth preferred embodiment of the present invention.
Figure 13:
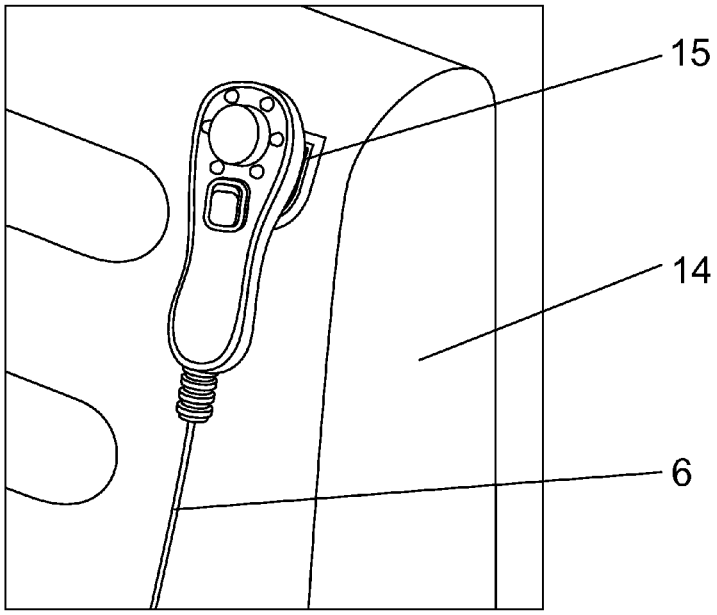
FIG. 13 is an enlarged perspective view of the area marked B in FIG. 12.
Figure 14:
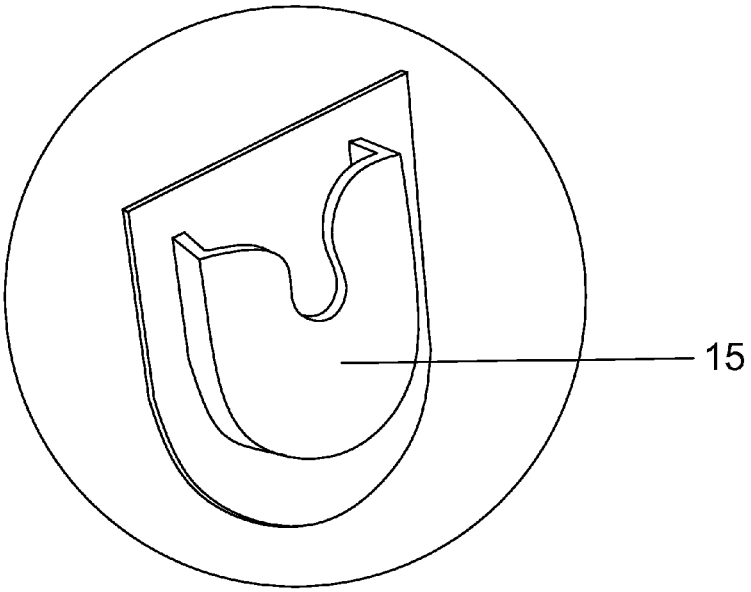
FIG. 14 is an enlarged perspective view of the area marked C n FIG. 12.

With reference to FIGS. 12, 13 and 14, the inflatable product may be an inflatable bed, an inflatable sofa, an inflatable desk or an inflatable cushion. In this embodiment, the inflatable product is an inflatable bed comprising an inflatable body 14, an air pump 16, a hook seat 15 defined on a side face of the inflatable body 14 and a remote control with a hook 10 corresponding to the hook seat 15 so that the hook 10 can be received in the hook seat 15 such that the air pump 16 is able to inflate or deflate the inflatable body 14.

After the remote control controls the air pump to inflate the inflatable body 14, hook 10 of the remote control is able to be attached to hook seat 15 which could be defined anywhere on the inflatable body 14 such as on a side face of the inflatable body 14 or on the front side face of the headboard portion of the inflatable body 14. If the remote control is simply placed alongside the bed, the user may just use the lighting module to provide light during night time for any desired purposes.

Although various embodiments have been given with the above descriptions and the figures, they should be appreciated that they are only the examples. It is obvious for the skilled in the art to make varieties of changes and modifications after reading the above descriptions, which should not be deemed as exceeding the scope of this invention. All the other changes based on the spirit of this invention may also be covered in this invention.

The invention claimed is:

1. A remote control for an inflatable product, the remote control comprising:

a top cover, a bottom cover correspondingly fitted to the top cover, an air pump switch mounted on the top cover to control on/off of the air pump, a lighting module, and a linkage provided between the top cover and the bottom cover to control lighting direction of the lighting module.

2. The remote control as claimed in claim 1, wherein the lighting module is composed of a light bulb device and a light switch controlling on/off as well as brightness of the light bulb device.

3. The remote control as claimed in claim 1, wherein lighting module further has a light seat and a light bulb device fixed on the light seat, wherein the light seat has a cavity defined in a side face thereof and the linkage has a head formed on a distal end thereof, and wherein the head is rotatably received in the cavity of the light seat such that the light seat as well as the light bulb device is able to rotate relative to the linkage.

4. The remote control as claimed in claim 3, wherein the linkage is extendable in a space defined between the top cove and the bottom cover.

5. The remote control as claimed in claim 4, wherein the linkage has a stop mechanism formed on a face thereof to limit extension of the linkage.

6. The remote control as claimed in claim 5, wherein the stop mechanism includes a boss formed on a face of the linkage and a position track to receive therein the boss so as to limit movement of the linkage.

7. The remote control as claimed in claim 6, wherein there is at least one light bulb in the light bulb device.

8. The remote control as claimed in claim 7, wherein the light bulb is a white light bulb, an LED light bulb, or a phosphorous light bulb.

9. The remote control claimed in claim 2, wherein the light switch is a push button.

10. The remote control as claimed in claim 1 being connected to an air pump via an electrical wire.

11. The remote control as claimed in claim 1 being connected to an air pump via infrared.

12. The remote control as claimed in claim 1 being connected to an air pump via infrared or radio frequency.

13. The remote control as claimed in claim 1, wherein a receptacle is provided to the bottom cover for facilitating storage of remote control.

14. The remote control as claimed in claim 13, wherein the receptacle device includes a hook or a hook seat formed on a side face of the bottom cover.

15. An inflatable product comprising an inflatable body, an air pump to inflate/deflate the inflatable body, a remote control as recited in claim 1 for controlling inflation/deflation of the inflatable body via the air pump and a receptacle device for storage of the remote control.

16. The inflatable product as claimed in claim 15, wherein the receptacle device is formed on any place of the inflatable body.

17. The inflatable product as claimed in claim 15, wherein the receptacle includes a hook or a hook seat.

18. The inflatable product as claimed in claim 15 being an inflatable bed, an inflatable sofa, an inflatable cushion or an inflatable chair.

19. The remote control as claimed in claim 1, wherein the lighting module is composed of a light bulb device whose on/off as well as brightness is controlled by the air pump switch.

* * * * *